US009353709B2

(12) United States Patent
Aso

(10) Patent No.: US 9,353,709 B2
(45) Date of Patent: May 31, 2016

(54) EVAPORATIVE FUEL TREATMENT APPARATUS

(71) Applicant: Shuichi Aso, Toyota (JP)

(72) Inventor: Shuichi Aso, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 173 days.

(21) Appl. No.: 14/105,474

(22) Filed: Dec. 13, 2013

(65) Prior Publication Data

US 2014/0165972 A1 Jun. 19, 2014

(30) Foreign Application Priority Data

Dec. 19, 2012 (JP) ..... 2012-277080

(51) Int. Cl.

| | |
|---|---|
| ***F02M 33/02*** | (2006.01) |
| ***F02M 25/08*** | (2006.01) |
| ***F02D 41/00*** | (2006.01) |
| ***F02D 41/30*** | (2006.01) |

(52) U.S. Cl.

CPC ..... *F02M 25/0854* (2013.01); *F02D 41/003* (2013.01); *F02D 41/3082* (2013.01); *F02M 25/0872* (2013.01); *F02D 2200/0406* (2013.01); *F02M 2025/0881* (2013.01)

(58) Field of Classification Search

CPC ..... F02M 25/0836; F02M 25/0854; F02M 2025/0881; F02M 25/08; F02D 41/0032; F02D 41/004; F02D 41/003; F02D 41/0007

USPC ..... 123/520, 510, 511, 519, 518, 521, 528, 123/548, 549

See application file for complete search history.

(56) References Cited

U.S. PATENT DOCUMENTS

| | | | | |
|---|---|---|---|---|
| 4,852,761 | A * | 8/1989 | Turner et al. | 220/746 |
| 4,926,829 | A * | 5/1990 | Tuckey | 123/497 |
| 6,182,693 | B1 * | 2/2001 | Stack et al. | 137/565.17 |
| 6,467,464 | B2 * | 10/2002 | Burke et al. | 123/520 |
| 6,877,488 | B2 * | 4/2005 | Washeleski et al. | 123/497 |
| 7,047,948 | B2 * | 5/2006 | Gerhardt et al. | 123/516 |
| 7,377,253 | B2 * | 5/2008 | Washeleski et al. | 123/198 D |
| 7,458,365 | B2 * | 12/2008 | Hazama | 123/509 |
| 8,327,830 | B2 * | 12/2012 | Makino et al. | 123/518 |
| 2009/0031995 | A1 * | 2/2009 | Tateishi | 123/509 |
| 2010/0288242 | A1 * | 11/2010 | Makino et al. | 123/521 |
| 2011/0120432 | A1 * | 5/2011 | Ulrey et al. | 123/568.15 |
| 2011/0307157 | A1 * | 12/2011 | Pursifull | 701/102 |

FOREIGN PATENT DOCUMENTS

| | | |
|---|---|---|
| JP | 62-185864 U | 11/1987 |
| JP | 04-287860 A | 10/1992 |

(Continued)

*Primary Examiner* — Lindsay Low
*Assistant Examiner* — Long T Tran
(74) *Attorney, Agent, or Firm* — Dinsmore & Shohl LLP

(57) ABSTRACT

An evaporative fuel treatment apparatus includes a fuel tank, a fuel pump, an adsorber, a purge mechanism, a supercharger and an electronic control unit. The fuel pump is configured to draw fuel that is supplied from the fuel tank to the internal combustion engine. The adsorber is provided inside the fuel tank and configured to adsorb evaporative fuel developed inside the fuel tank. The purge mechanism is configured to carry out purging for introducing fuel, desorbed from the adsorber, into an intake pipe of the internal combustion engine. The supercharger is configured to feed air into the intake pipe. The electronic control unit is configured to increase an amount of heat that is transferred from the fuel pump to the adsorber on the condition that an intake negative pressure in the intake pipe is higher than a predetermined threshold.

20 Claims, 11 Drawing Sheets

(56) References Cited

FOREIGN PATENT DOCUMENTS

| | | | |
|---|---|---|---|
| JP | 05-065856 | A | 3/1993 |
| JP | 08-042405 | A | 2/1996 |
| JP | 11-013559 | A | 1/1999 |
| WO | 2014020865 | A1 | 2/2014 |
| WO | 2014020893 | A1 | 2/2014 |

* cited by examiner

EVAPORATIVE FUEL TREATMENT APPARATUS

INCORPORATION BY REFERENCE

The disclosure of Japanese Patent Application No. 2012-277080 filed on Dec. 19, 2012 including the specification, drawings and abstract is incorporated herein by reference in its entirety.

BACKGROUND OF THE INVENTION

1. Field of the Invention

The invention relates to an evaporative fuel treatment apparatus.

2. Description of Related Art

Japanese Patent Application Publication No. 04-287860 (JP 04-287860 A) discloses a evaporative fuel treatment apparatus that includes a compressor of a supercharger, a canister, a purge open/close valve and a fail-safe open/close valve. The compressor of the supercharger is provided upstream of a throttle valve in an intake passage of an engine. The canister adsorbs evaporative fuel that is developed in a fuel tank, and is used to guide evaporative fuel via a purge passage to a downstream side of the throttle valve in the intake passage. The purge open/close valve is provided in the purge passage, and controls a purge amount of evaporative fuel. The fail-safe open/close valve is provided in the purge passage. One of chambers is comparted in the fail-safe open/close valve by a diaphragm such that the purge passage is closed at the time when the throttle valve is fully closed communicates with the intake passage at a portion downstream of the throttle valve. The other one of the chambers comparted by the diaphragm in the fail-safe open/close valve communicates with the intake passage at a portion near a downstream side of the compressor of the supercharger.

SUMMARY OF THE INVENTION

However, in the evaporative fuel treatment apparatus described in JP 04-287860 A, an intake negative pressure decreases with an increase in the pressure in the intake passage due to the supercharger, so there are less opportunities to allow the canister (hereinafter, also referred to as "adsorber") to perform purging.

Therefore, in the evaporative fuel treatment apparatus, there is an inconvenience that it is not possible to sufficiently exercise the evaporative fuel desorption performance of the adsorber.

The invention provides an evaporative fuel treatment apparatus that is able to sufficiently exercise the desorption performance of an adsorber in a vehicle equipped with a supercharger as well.

An aspect of the invention provides an evaporative fuel treatment apparatus. The evaporative fuel treatment apparatus includes: a fuel tank configured to store fuel for an internal combustion engine; a fuel pump configured to draw fuel that is supplied from the fuel tank to the internal combustion engine; an adsorber provided inside the fuel tank and configured to adsorb evaporative fuel developed inside the fuel tank; a purge mechanism configured to carry out purging for introducing fuel, desorbed from the adsorber, into an intake pipe of the internal combustion engine; a supercharger configured to feed air into the intake pipe; and an electronic control unit configured to increase an amount of heat that is transferred from the fuel pump to the adsorber on the condition that an intake negative pressure in the intake pipe is higher than a predetermined threshold.

With this configuration, while the intake negative pressure is ensured to such a degree that it is possible to carry out purging, the evaporative fuel treatment apparatus according to the aspect of the invention improves the desorption performance of the adsorber during purging by heating the adsorber through an increase in the amount of heat that is transferred from the fuel pump to the adsorber. Therefore, it is possible to sufficiently exercise the desorption performance of the adsorber even in the vehicle that includes the supercharger.

In the evaporative fuel treatment apparatus according to the above aspect, the purge mechanism may include a solenoid valve configured to change an opening degree of a purge line that communicates an inside of the adsorber with an inside of the intake pipe, the evaporative fuel treatment apparatus may further include a negative pressure sensor provided downstream of the solenoid valve in the purge line, and the electronic control unit may be configured to determine whether the intake negative pressure in the intake pipe is higher than the predetermined threshold on the basis of a negative pressure measured by the negative pressure sensor.

With this configuration, the evaporative fuel treatment apparatus according to the aspect of the invention reliably detects the intake negative pressure with the use of the negative pressure sensor, so it is possible to increase the amount of heat that is transferred from the fuel pump to the adsorber at appropriate timing.

In the evaporative fuel treatment apparatus according to the above aspect, the purge mechanism may include a solenoid valve configured to change an opening degree of a purge line that communicates an inside of the adsorber with an inside of the intake pipe and a check valve provided downstream of the solenoid valve in the purge line, the check valve being configured to open when the intake negative pressure in the intake pipe is higher than the predetermined threshold and close when the intake negative pressure in the intake pipe is not higher than the threshold, the check valve may be configured to generate a different signal between a valve open state and a valve closed state, and the electronic control unit may be configured to determine whether the intake negative pressure in the intake pipe is higher than the predetermined threshold on the basis of the signal generated by the check valve.

With this configuration, the evaporative fuel treatment apparatus according to the aspect of the invention determines whether the intake negative pressure in the intake pipe is higher than the predetermined threshold on the basis of the signal generated by the check valve that opens when the intake negative pressure in the intake pipe is an intake negative pressure at which it is allowed to carry out purging, so it is possible to increase the amount of heat that is transferred from the fuel pump to the adsorber at appropriate timing.

In addition, in the evaporative fuel treatment apparatus according to the above aspect, the electronic control unit may be configured to increase the amount of heat that is transferred from the fuel pump to the adsorber via the fuel.

With this configuration, the evaporative fuel treatment apparatus according to the aspect of the invention is able to heat the adsorber by fuel heated by the fuel pump.

In addition, in the evaporative fuel treatment apparatus according to the above aspect, the electronic control unit may be configured to increase the amount of heat that is transferred from the fuel pump to the adsorber via fuel discharged from the fuel pump.

With this configuration, the evaporative fuel treatment apparatus according to the aspect of the invention is able to heat the adsorber by fuel heated by the fuel pump and discharged from the fuel pump.

In addition, in the evaporative fuel treatment apparatus according to the above aspect, the electronic control unit may be configured to increase the amount of heat that is transferred from the fuel pump to the adsorber by increasing driving force of the fuel pump.

With this configuration, the evaporative fuel treatment apparatus according to the aspect of the invention heats the fuel pump by increasing the driving force of the fuel pump, so it is possible to increase the amount of heat that is transferred from the fuel pump to the adsorber.

According to the aspect of the invention, it is possible to provide the evaporative fuel treatment apparatus that is able to sufficiently exercise the desorption performance of the adsorber in the vehicle equipped with the supercharger as well.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, embodiments of an evaporative fuel treatment apparatus according to the invention will be described with reference to the accompanying drawings.

First Embodiment

Figure 1:
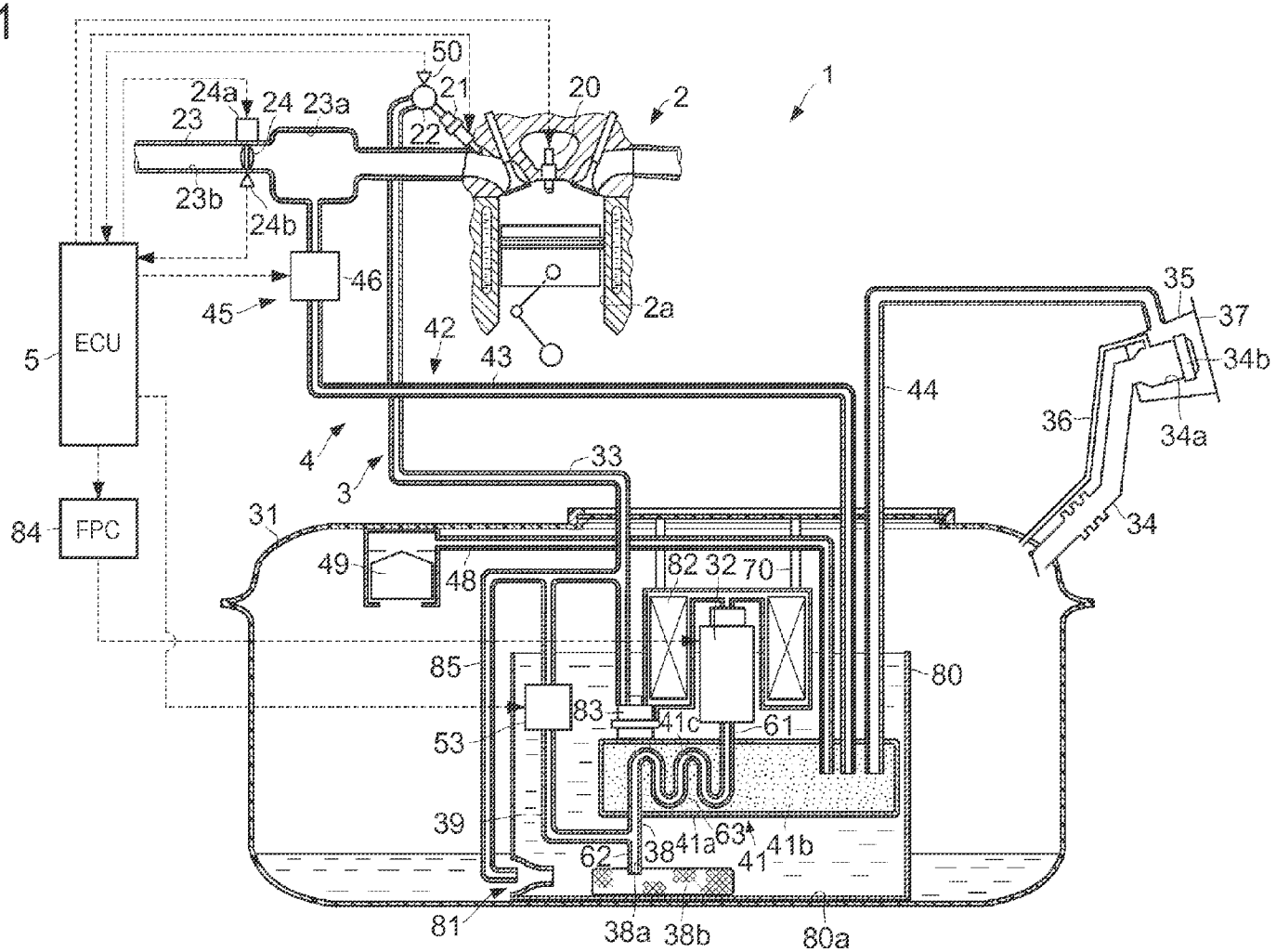
FIG. 1 is a schematic configuration view of a relevant portion, including a driving internal combustion engine and a fuel system of the internal combustion engine, in a vehicle on which an evaporative fuel treatment apparatus according to a first embodiment of the invention is mounted.

FIG. 1 shows the configuration of a relevant portion of a vehicle on which the evaporative fuel treatment apparatus according to a first embodiment of the invention, that is, the mechanism of a driving internal combustion engine and a fuel system that supplies fuel to the internal combustion engine and purges fuel from the fuel tank. The internal combustion engine according to the present embodiment uses highly-volatile fuel, and is mounted on the vehicle in order to cause the vehicle to travel.

First, the configuration will be described.

As shown in FIG. 1, the vehicle 1 according to the present embodiment includes an engine 2, a fuel supply mechanism 3 having a fuel tank 31, a fuel purge system 4 that constitutes the evaporative fuel treatment apparatus, and an electronic control unit (ECU) 5.

The engine 2 is formed of a spark-ignition multi-cylinder internal combustion engine, for example, a four-cycle in-line four-cylinder engine, that uses ignition plugs 20 that are controlled by the ECU 5.

Injectors 21 (fuel injection valves) are respectively mounted at intake port portions of four cylinders 2*a* (only one of them is shown in FIG. 1) of the engine 2, and the plurality of injectors 21 are connected to a delivery pipe 22.

Highly-volatile fuel (for example, gasoline) is pressurized to a fuel pressure required of the engine 2, and is supplied from a fuel pump 32 (described later) to the delivery pipe 22.

An intake pipe 23 is connected to the intake port portions of the engine 2. A surge tank 23*a* is provided in the intake pipe 23. The surge tank 23*a* has a predetermined volume and is used to suppress intake pulsation and intake interference.

An intake passage 23*b* is formed inside the intake pipe 23. A throttle valve 24 is provided in the intake passage 23*b*. The throttle valve 24 is driven by a throttle actuator 24*a* such that the opening degree is adjustable.

The throttle valve 24 adjusts the intake air amount of the engine 2 by adjusting the opening degree of the intake passage 23*b* through control from the ECU 5. A throttle sensor 24*b* is provided at the throttle valve 24. The throttle sensor 24*b* detects the opening degree of the throttle valve 24.

The fuel supply mechanism 3 includes the fuel tank 31, an internal tank 80, the fuel pump 32, a fuel supply line 33 and a suction line 38. The internal tank 80 is provided inside the fuel tank 31. The fuel supply line 33 connects the delivery pipe 22 to the fuel pump 32. The suction line 38 is provided upstream of the fuel pump 32.

The fuel tank 31 is arranged at the lower side of the body of the vehicle 1, and stores fuel that is consumed by the engine 2 so as to be able to supply the fuel. The internal tank 80 is formed in a substantially cylindrical shape with a bottom, and is provided inside the fuel tank 31.

The internal tank 80 is able to store fuel inside. Specifically, the internal tank 80 includes a jet pump 81 that introduces fuel inside the fuel tank 31 into the internal tank 80. The jet pump 81 introduces fuel into the internal tank 80 in response to the operation of the fuel pump 32.

The shape of the internal tank 80 is not limited to the cylindrical shape, and may be a square tubular shape or a box shape. The shape of the internal tank 80 is not specifically limited. A canister 41, a suction filter 38*b*, a fuel filter 82 and a pressure regulator 83 are accommodated inside the internal tank 80 in addition to the fuel pump 32.

The fuel pump 32 is of a variable discharge capacity (displacement and discharge pressure) type that is able to draw fuel inside the fuel tank 31 and pressurize the fuel to a predetermined feed fuel pressure or higher, and is, for example, formed of a circumferential flow pump. Although the detailed internal configuration of the fuel pump 32 is not shown, the fuel pump 32 includes a pump driving impeller and a built-in motor that drives the impeller.

The fuel pump 32 is able to change its discharge capacity per unit time by changing at least one of the rotation speed and rotation torque of the pump driving impeller in accordance with the driving voltage and load torque of the built-in motor.

In order to change the discharge capacity of the fuel pump 32 in this way, the fuel supply mechanism 3 includes a fuel pump controller (FPC) 84 that controls the driving voltage of the fuel pump 32 in response to control from the ECU 5.

The casing of the fuel filter 82 is held inside the internal tank 80 integrally with the fuel pump 32 by a holding mechanism 70. The fuel filter 82 filters fuel discharged from the fuel pump 32. In the present embodiment, the fuel filter 82 is a known one. The casing of the fuel filter 82 is formed so as to surround the fuel pump 32, and filters fuel discharged from the fuel pump 32.

The pressure regulator 83 is formed of an emergency normally-closed valve provided downstream of the fuel filter 82. The pressure regulator 83 opens when the fuel pressure in the fuel filter 82 becomes higher than or equal to a predetermined fuel pressure, and returns redundant fuel into the internal tank 80.

The fuel supply line 33 forms a fuel supply passage that communicates an output port of the pressure regulator 83 and the inside of the delivery pipe 22 with each other. A pilot line 85 is connected to the fuel supply line 33. The pilot line 85 is used to supply driving flow to the jet pump 81 by returning at least part of fuel discharged from the fuel pump 32 inside the fuel tank 31.

Here, in FIG. 1, the pilot line 85 and the fuel supply line 33 are shown as substantially equivalent lines; however, the passage cross-sectional areas of the pilot line 85 and fuel supply line 33 may be varied or an appropriate throttle may be provided in accordance with the set ratio of the maximum flow rate of fuel inside the pilot line 85 to the maximum flow rate of fuel inside the fuel supply line 33.

The suction line 38 forms a suction passage 38*a* upstream of the fuel pump 32. The suction filter 38*b* is provided at the most upstream portion of the suction passage 38*a*. The suction filter 38*b* is a known one, and filters fuel that is introduced into the fuel pump 32.

On the other hand, a refueling pipe 34 is provided at the fuel tank 31 so as to protrude from the fuel tank 31 laterally or rearward of the vehicle 1. A fuel inlet 34*a* is formed at the distal end of the refueling pipe 34 in the protruding direction. The fuel inlet 34*a* is accommodated inside a fuel inlet box 35 provided at the body (not shown) of the vehicle 1.

The refueling pipe 34 includes a circulation line 36 that communicates the upper portion of the fuel tank 31 with the upstream portion inside the refueling pipe 34. A fuel lid 37 is provided at the fuel inlet box 35. The fuel lid 37 is opened outward at the time when fuel is fed.

When fuel is fed, fuel is allowed to be poured into the fuel tank 31 via the fuel inlet 34*a* by opening the fuel lid 37 and removing a cap 34*b* detachably attached to the fuel inlet 34*a*.

The fuel purge system 4 is interposed between the fuel tank 31 and the intake pipe 23, more specifically, between the fuel tank 31 and the surge tank 23*a*. The fuel purge system 4 is able to release evaporative fuel developed inside the fuel tank 31 to the intake passage 23*b* at the time of the intake stroke of the engine 2 and cause the released evaporative fuel to combust.

The fuel purge system 4 includes the canister 41 (adsorber), a purge mechanism 42 and a purge control mechanism 45. The canister 41 adsorbs evaporative fuel developed inside the fuel tank 31. The purge mechanism 42 carries out purging for introducing purge gas, including fuel and air, desorbed from the canister 41 by passing air through the canister 41, into the intake pipe 23 of the engine 2. The purge control mechanism 45 suppresses fluctuations in air-fuel ratio in the engine 2 by controlling the amount of purge gas that is introduced into the intake pipe 23.

The canister 41 contains an adsorbent 41*b*, such as activated carbon, inside a canister case 41*a*, and is provided inside the internal tank 80 so as to be distanced from an inner bottom face 80*a* of the internal tank 80. The inside (adsorbent containing space) of the canister 41 communicates with an upper space inside the fuel tank 31 via an evaporation line 48 and a gas-liquid separation valve 49.

Thus, when fuel evaporates inside the fuel tank 31 and evaporative fuel accumulates in the upper space inside the fuel tank 31, the canister 41 is able to adsorb evaporative fuel with the use of the adsorbent 41*b*. In addition, when the liquid level of fuel rises or the liquid level of fuel fluctuates inside the fuel tank 31, the gas-liquid separation valve 49 having a check valve function floats and closes the distal end portion of the evaporation line 48.

The purge mechanism 42 includes a purge line 43 and an atmosphere line 44. The purge line 43 communicates the inside of the canister 41 with the internal portion of the surge tank 23*a* within the intake passage 23*b* of the intake pipe 23. The atmosphere line 44 opens the inside of the canister 41 to an atmosphere side, for example, an atmospheric pressure space inward of the fuel inlet box 35.

When an intake negative pressure is generated inside the surge tank 23*a* during operation of the engine 2, the purge mechanism 42 is able to introduce the intake negative pressure to one end side inside the canister 41 through the purge line 43, and introduce the atmosphere to the other end side inside the canister 41 through the atmosphere line 44.

Thus, the purge mechanism 42 is able to desorb (release) fuel, adsorbed by the adsorbent 41*b* of the canister 41 and held inside the canister 41, from the canister 41 and introduce the fuel into the surge tank 23*a*.

The purge control mechanism 45 includes a purging vacuum solenoid valve (hereinafter, referred to as "purging VSV") 46 that is controlled by the ECU 5.

The purging VSV 46 is provided in the purge line 43. The purging VSV 46 is able to variably control the amount of fuel that is desorbed from the canister 41 by changing the opening degree of a halfway portion of the purge line 43.

Specifically, the purging VSV 46 is able to change its opening degree through duty control over its exciting current by the ECU 5, and is able to introduce fuel desorbed from the canister 41 due to the intake negative pressure in the intake pipe 23 into the surge tank 23*a* as purge gas together with air at a purge rate based on the duty ratio.

In the present embodiment, part of the suction line 38 that connects the suction filter 38*b* to the fuel pump 32 passes through the inside of the canister 41.

Specifically, the suction line 38 is formed of a pump-side connecting portion 61, a filter-side connecting portion 62 and a heat transfer line portion 63. The pump-side connecting portion 61 is connected to a suction port of the fuel pump 32. The filter-side connecting portion 62 is connected to the suction filter 38*b*. The heat transfer line portion 63 is located between these pump-side connecting portion 61 and filter-side connecting portion 62.

Particularly, the heat transfer line portion 63 is arranged inside the canister 41. The heat transfer line portion 63, for example, has a meander shape inside the canister 41. Thus, it is possible to increase the contact area between fuel introduced into the fuel pump 32 and the adsorbent 41*b* of the canister 41 on which fuel is adsorbed, so it is possible to increase a heat transfer amount.

The shape of the heat transfer line portion 63 is not limited to the meander shape as long as it is possible to increase the contact area with the adsorbent 41*b*. For example, the shape of the heat transfer line portion 63 may be various shapes, such as a shape in which a line is branched off into a plurality of paths inside the adsorbent 41*b* and these plurality of paths are arranged in parallel with each other and a spiral shape.

Here, the heat transfer line portion 63 of the suction line 38 is integrally coupled to the canister case 41*a*, and a heat transfer surface 41*c* is formed of the inner wall surface of the heat transfer line portion 63. The heat transfer surface 41*c* is the inner wall surface of the internal passage of the canister 41.

The heat transfer surface 41*c* is able to guide fuel flowing inside the fuel tank 31 during operation of the fuel pump 32, particularly, fuel that is introduced into the fuel pump 32, in the suction direction. In addition, the heat transfer surface 41*c* is able to transfer heat between the canister 41 and suction-side fuel flowing in the direction in which fuel is introduced into the fuel pump 32 within fuel inside the fuel tank 31.

That is, the heat transfer line portion 63 is made of, for example, a metal raw material having a high heat conductivity such that, when there is a temperature difference between the suction-side fuel and the canister 41, it is possible to cause good heat transfer to occur at the heat transfer surface 41*c* and to efficiently transfer heat from the heat transfer line portion 63 to the adsorbent 41*b* on which fuel is adsorbed.

A return line 39 is connected between the fuel supply line 33 and the suction line 38. The return line 39 returns fuel discharged from the fuel pump 32, more specifically, fuel, discharged from the fuel pump 32 and not supplied into the fuel supply line 33 or the pilot line 85, to the suction passage 38*a* upstream of the canister 41 inside the fuel tank 31.

Specifically, the return line 39 is arranged inside the fuel tank 31. One end of the return line 39 at the upstream side in the return direction branches off from the fuel supply line 33, and one end of the return line 39 at the downstream side in the return direction is connected to the filter-side connecting portion 62 of the suction line 38.

The return line 39 constitutes a return mechanism that is able to return fuel discharged from the fuel pump 32 to the intake side of the fuel pump 32 inside the fuel tank 31. In the present embodiment, the return line 39 returns fuel discharged from the fuel pump 32 into the suction line 38 upstream of the canister 41.

In FIG. 1, the return line 39 and the fuel supply line 33 are shown as substantially equivalent lines; however, the passage cross-sectional areas of the return line 39 and fuel supply line 33 may be varied or an appropriate throttle may be provided in accordance with the set ratio of the maximum flow rate of fuel inside the return line 39 to the maximum flow rate of fuel inside the fuel supply line 33.

A fuel pressure adjustment electromagnetic valve 53 is provided in the return line 39. The fuel pressure adjustment electromagnetic valve 53 is able to variably control the fuel pressure in the delivery pipe 22 by changing the opening degree of a halfway portion of the return line 39.

Specifically, the fuel pressure adjustment electromagnetic valve 53 is of a normally-closed type, and switches into a valve open state on the basis of a valve open signal from the ECU 5. Specifically, the fuel pressure adjustment electromagnetic valve 53 is, for example, a known normally-closed electromagnetic valve in which a valve element is urged by an urging member, such as a compression spring, toward a normally-closed side and the valve element is urged in a valve opening direction by exciting an electromagnetic solenoid in response to the valve open signal from the ECU 5. The fuel pressure adjustment electromagnetic valve 53 may be a normally-open type, and may switch into a valve closed state on the basis of a valve close signal from the ECU 5.

Figure 2:
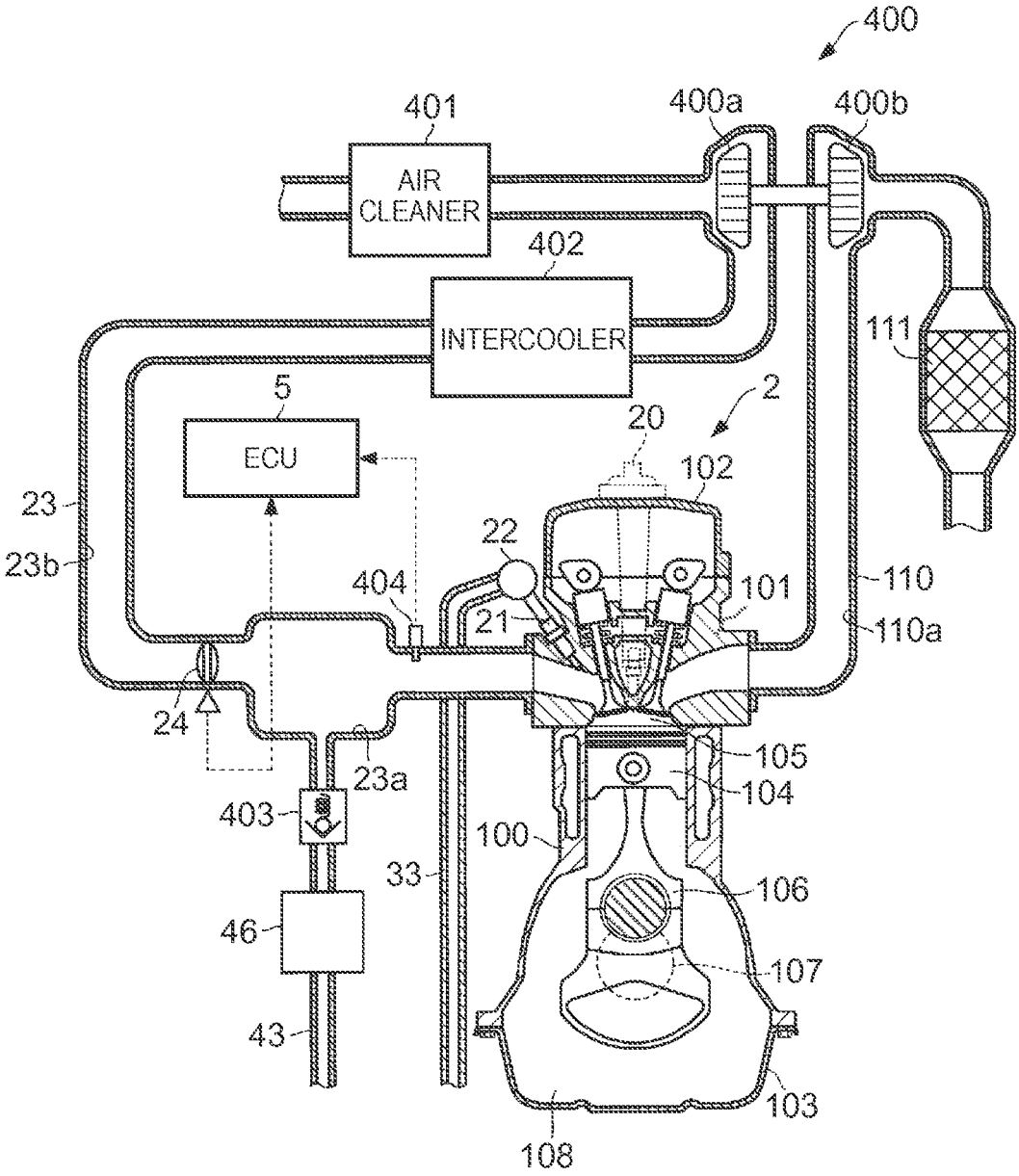
FIG. 2 is a schematic configuration view that shows the configuration of the driving internal combustion engine and its adjacent portions in the vehicle on which the evaporative fuel treatment apparatus according to the first embodiment of the invention is mounted.

As shown in FIG. 2, the engine 2 includes a cylinder block 100, a cylinder head 101, a cylinder head cover 102 and an oil pan 103. The cylinder head 101 is fixed to the upper portion of the cylinder block 100. The cylinder head cover 102 covers the upper portion of the cylinder head 101. The oil pan 103 is fixed to the lower portion of the cylinder block 100, and contains oil. The four cylinders 2*a* are defined by the cylinder block 100 and the cylinder head 101.

Pistons 104 are respectively accommodated in the cylinders 2*a* so as to be reciprocally movable. Combustion chambers 105 are defined by the cylinder block 100, the cylinder head 101 and the pistons 104. The engine 2 performs a series of four strokes, that is, intake stroke, compression stroke, combustion stroke and exhaust stroke, while each of the pistons 104 makes two reciprocations.

Each piston 104 accommodated in a corresponding one of the cylinders 2*a* is coupled to a crankshaft 107 via a corresponding connecting rod 106. Each connecting rod 106 converts the reciprocal motion of the corresponding piston 104 to the rotational motion of the crankshaft 107.

An exhaust pipe 110 is connected to exhaust port portions of the engine 2. A catalyst device 111 is provided in an exhaust passage 110*a* formed by the exhaust pipe 110. The catalyst device 111 generally includes a three-way catalyst that is able to efficiently remove toxic substances, such as unburned hydrocarbons (HC), carbon monoxide (CO) and nitrogen oxides (NOx), contained in exhaust gas. The three-way catalyst desirably has the function of efficiently removing NOx from exhaust gas having a high NOx content.

In the present embodiment, a supercharger 400 is connected to the engine 2. The supercharger 400 feeds air into the intake passage 23*b* by using exhaust gas emitted from the exhaust passage 110*a*. The supercharger 400 includes an intake air compressor 400*a* and an exhaust turbine 400*b* that are coupled to each other and rotate integrally.

The supercharger 400 is able to introduce positive-pressure air into the intake pipe 23 by rotating the exhaust turbine 400*b* using exhaust energy of exhaust gas and, as a result, rotating the intake air compressor 400*a*.

An air cleaner 401 and an intercooler 402 are provided in the intake pipe 23. The air cleaner 401 cleans intake air with the use of a filter at a portion upstream of the supercharger 400. The intercooler 402 cools intake air, of which the temperature is increased through supercharging, at a portion downstream of the supercharger 400. In the exhaust pipe 110, the catalyst device 111 is provided downstream of the supercharger 400.

Positive-pressure air may be introduced into the intake pipe 23 by the supercharger 400, so a check valve 403 is provided in the purge line 43 on the surge tank 23*a* side with respect to the purging VSV 46.

The check valve 403 is formed of a known one-way valve that closes when the inside of the intake pipe 23 has a positive pressure and that opens when the inside of the intake pipe 23 has a negative pressure. By providing the check valve 403, air introduced into the intake pipe 23 is prevented from flowing into the canister 41.

In addition, in the present embodiment, a negative pressure sensor 404 is provided in the intake pipe 23 at a portion downstream of the surge tank 23*a*. The negative pressure sensor 404 is used to measure the negative pressure in the intake pipe 23. The negative pressure sensor 404 just needs to be provided on the surge tank 23*a* side with respect to the purging VSV 46 in the purge line 43.

In FIG. 1, the ECU 5 is formed of a microprocessor that includes a central processing unit (CPU) (not shown), a read only memory (ROM) (not shown), a random access memory (RAM) (not shown), a flash memory (not shown) and an input/output port (not shown).

A program for causing the microprocessor to function as the ECU 5 is stored in the ROM of the ECU 5. That is, the CPU of the ECU 5 executes the program stored in the ROM using the RAM as a work area. Thus, the microprocessor functions as the ECU 5.

Various sensors are connected to the input side of the input/output port of the ECU 5. The various sensors include a fuel pressure sensor 50, the throttle sensor 24*b* and the negative pressure sensor 404. The fuel pressure sensor 50 detects the fuel pressure in the delivery pipe 22.

In addition, various controlled objects are connected to the output side of the input/output port of the ECU 5. The various controlled objects include the ignition plugs 20, the throttle actuator 24*a*, the purging VSV 46, the fuel pressure adjustment electromagnetic valve 53, the FPC 84, and the like.

The ECU 5 is able to control the purge rate through duty control over the purging VSV 46 on the basis of various pieces of sensor information. For example, the ECU 5 causes the purge mechanism 42 to carry out purging by actuating the purging VSV 46 on the condition that the opening degree of the throttle valve 24, obtained from the throttle sensor 24*b*, is lower than a predetermined opening degree when the engine 2 is in a predetermined operating state.

In addition, in the present embodiment, the ECU 5 constitutes a heat transfer amount control unit that increases the amount of heat that is transferred from the fuel pump 32 to the canister 41 on the condition that the intake negative pressure in the intake pipe 23 is higher than a predetermined threshold. Specifically, the ECU 5 determines whether the intake negative pressure in the intake pipe 23 is higher than the threshold on the basis of the negative pressure measured by the negative pressure sensor 404.

In addition, when the ECU 5 determines that the intake negative pressure in the intake pipe 23 is higher than the threshold, the ECU 5 increases the amount of heat that is transferred from the fuel pump 32 to the canister 41. For example, the ECU 5 increases the driving force of the fuel pump 32 by increasing the driving voltage of the fuel pump 32 through control over the FPC 84, and opens the fuel pressure adjustment electromagnetic valve 53. In this way, the ECU 5 constitutes the heat transfer amount control unit in cooperation with the FPC 84.

When the fuel pressure adjustment electromagnetic valve 53 is opened by the ECU 5, fuel at the intake side in the fuel pump 32, particularly, fuel inside the suction line 38, joins into fuel discharged from the fuel pump 32 and returned to the intake side through the return line 39, so the fuel inside the suction line 38 includes fuel discharged from the fuel pump 32 and fuel newly introduced through the suction filter 38*b*.

In this way, when fuel discharged from the fuel pump 32 is returned to the intake side of the fuel pump 32 inside the fuel tank 31 through the return line 39, the heat transfer surface 41*c* of the canister 41 is allowed to transfer heat between the canister 41 and fuel inside the suction line 38, flowing in the direction in which fuel is introduced into the fuel pump 32 and including fuel discharged from the fuel pump 32.

Figure 3:
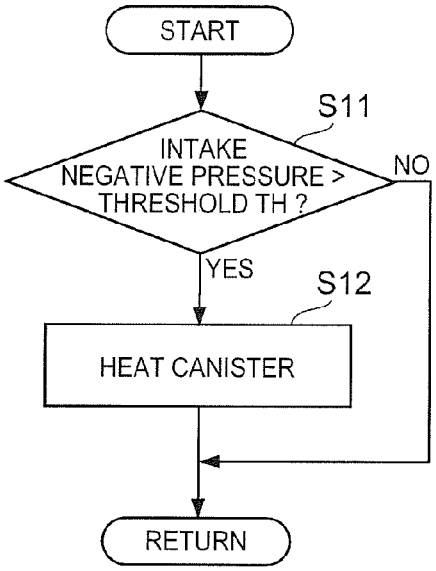
FIG. 3 is a flowchart that shows a canister temperature increasing operation of the evaporative fuel treatment apparatus according to the first embodiment of the invention.

Next, a canister temperature increasing operation of the evaporative fuel treatment apparatus according to the present embodiment will be described with reference to the flowchart shown in FIG. 3. The canister temperature increasing operation described below is repeatedly executed in a period from when the ECU 5 starts up to when the ECU 5 stops.

Initially, the ECU 5 determines whether the intake negative pressure in the intake pipe 23 is higher than or equal to a threshold TH on the basis of the negative pressure measured by the negative pressure sensor 404 (step S11). Here, when it is determined that the intake negative pressure in the intake pipe 23 is not higher than the threshold TH, the ECU 5 ends the canister temperature increasing operation. On the other hand, when it is determined that the intake negative pressure in the intake pipe 23 is higher than the threshold TH, the ECU 5 heats the canister 41 (step S12), and ends the canister temperature increasing operation.

Specifically, when it is not in a state where the canister 41 is being heated in step S12, the ECU 5 increases the driving voltage of the fuel pump 32 by controlling the FPC 84, and opens the fuel pressure adjustment electromagnetic valve 53, thus starting to heat the canister 41. In addition, when it is in a state where the canister 41 is being heated, the ECU 5 keeps this state.

Next, the operation will be described.

Figure 4:
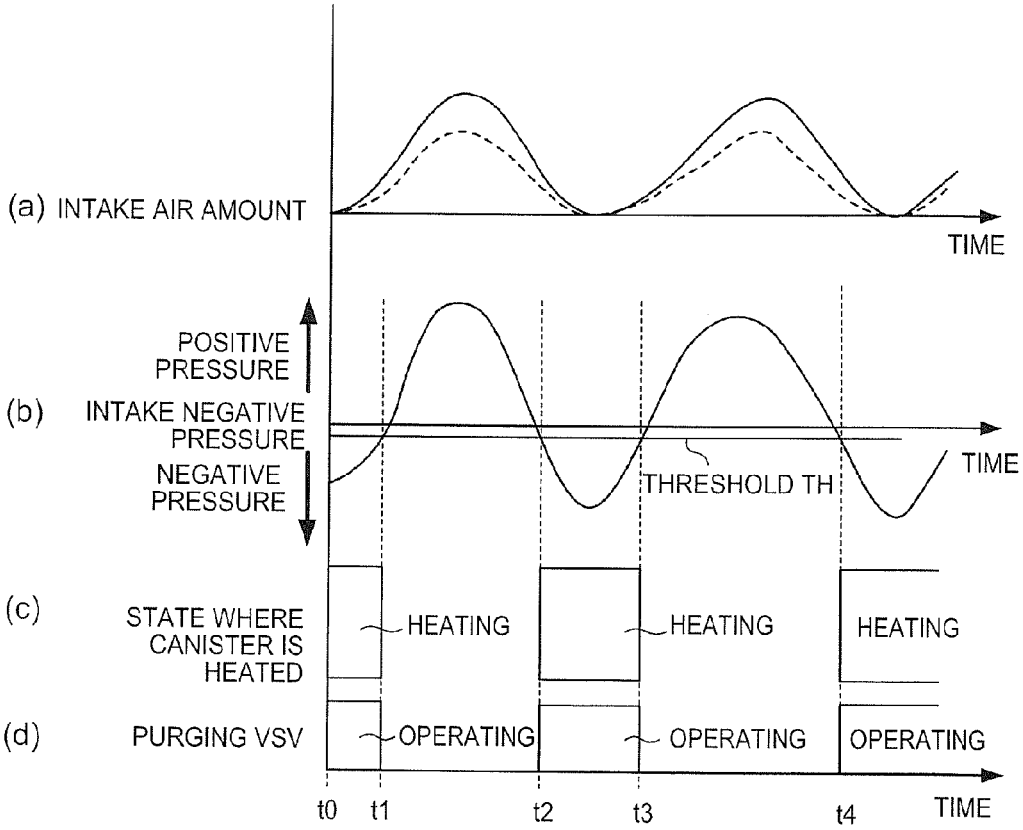
FIG. 4 is a graph that shows the relationship among various portions of the vehicle on which the evaporative fuel treatment apparatus according to the first embodiment of the invention is mounted.

In FIG. 4, (a) shows a variation in the amount of intake air that is introduced into the engine 2, (b) shows a variation in the negative pressure in the intake pipe 23, (c) shows a variation in the state where the canister 41 is heated, and (d) shows a variation in the operating state of the purging VSV 46.

The graph indicated by the dashed line in (a) shows the intake air amount on the assumption that the supercharger 400 is not provided. The graph indicated by the continuous line in (a) shows the intake air amount according to the present embodiment in which the supercharger 400 is provided.

In this way, when the intake air amount varies, because the vehicle 1 includes the supercharger 400, the negative pressure in the intake pipe 23, that is, the pressure in the intake pipe 23, varies between a negative pressure and a positive pressure on the basis of the intake air amount as shown in (b).

The ECU 5 heats the canister 41 as shown in (c) in a period during which the negative pressure in the intake pipe 23 is higher than the threshold TH, specifically, between time t0 and time t1, between time t2 to time t3 and after time t4, and operates the purging VSV 46 as shown in (d).

As described above, in the present embodiment, while the intake negative pressure is ensured to such a degree that it is possible to carry out purging, the desorption performance of the canister 41 during purging is improved by heating the canister 41 through an increase in the amount of heat that is transferred from the fuel pump 32 to the canister 41, so it is possible to sufficiently exercise the desorption performance of the canister 41 even in the vehicle 1 that includes the supercharger 400.

In addition, in the present embodiment, the intake negative pressure is reliably detected with the use of the negative pressure sensor 404, so it is possible to increase the amount of heat that is transferred from the fuel pump 32 to the canister 41 at appropriate timing.

Second Embodiment

Figure 5:
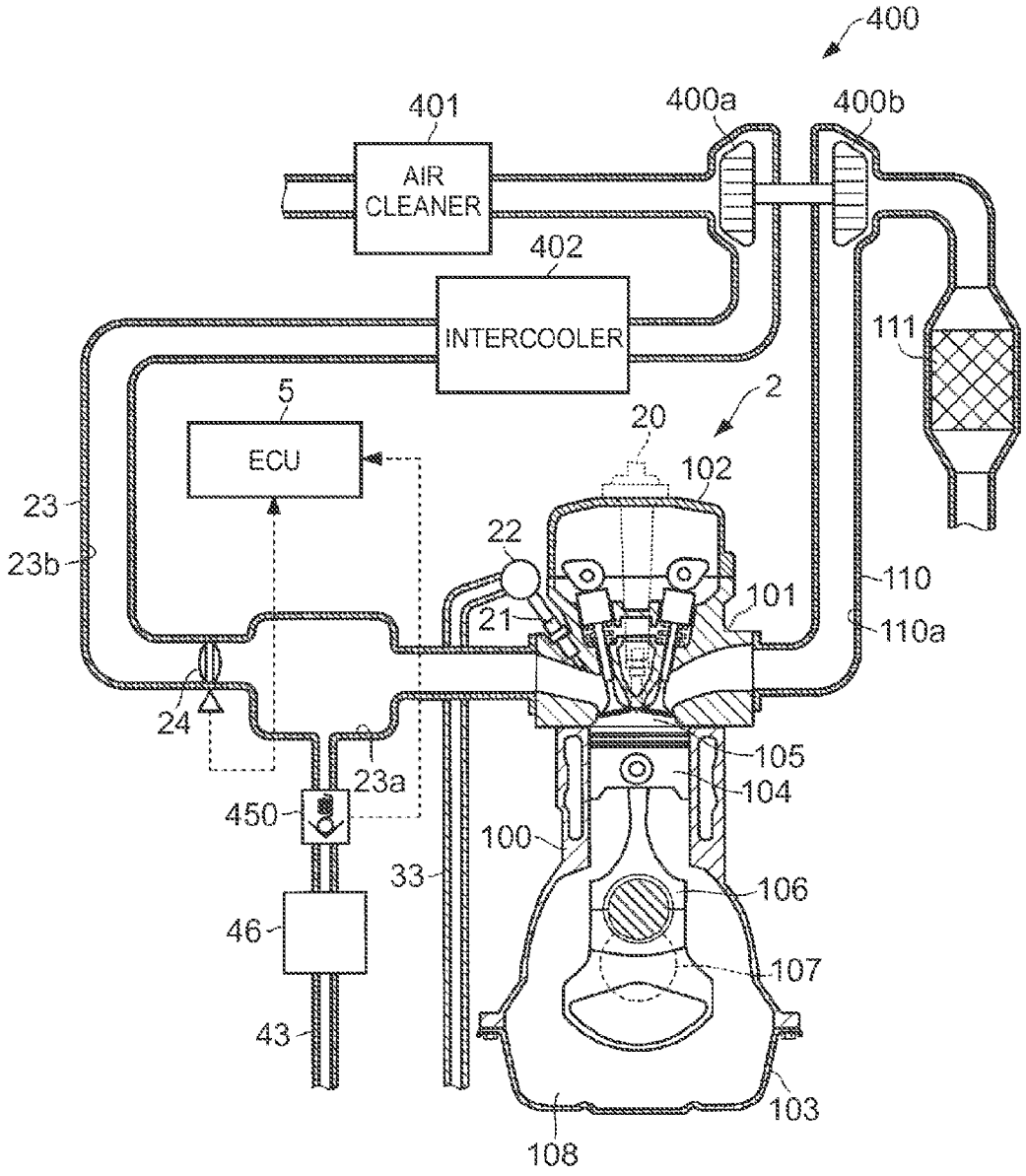
FIG. 5 is a schematic configuration view that shows the configuration of a driving internal combustion engine and its adjacent portions in the vehicle on which an evaporative fuel treatment apparatus according to a second embodiment of the invention is mounted.

FIG. 5 shows the configuration of a driving internal combustion engine and its adjacent portions in a vehicle on which an evaporative fuel treatment apparatus according to a second embodiment of the invention is mounted.

The present embodiment differs from the first embodiment in the configuration of the engine 2 and its adjacent portions; however, the other major configuration is similar to that of the first embodiment. Thus, like reference numerals denote components similar to those of the first embodiment, and the difference from the first embodiment will be described below.

As shown in FIG. 5, in the present embodiment, instead of the check valve 403 according to the first embodiment, a check valve 450 is provided. The check valve 450 outputs an electric signal different between an open state and a closed state. In addition, in the present embodiment, the negative pressure sensor 404 is omitted from the configuration near the engine 2.

Figure 6:
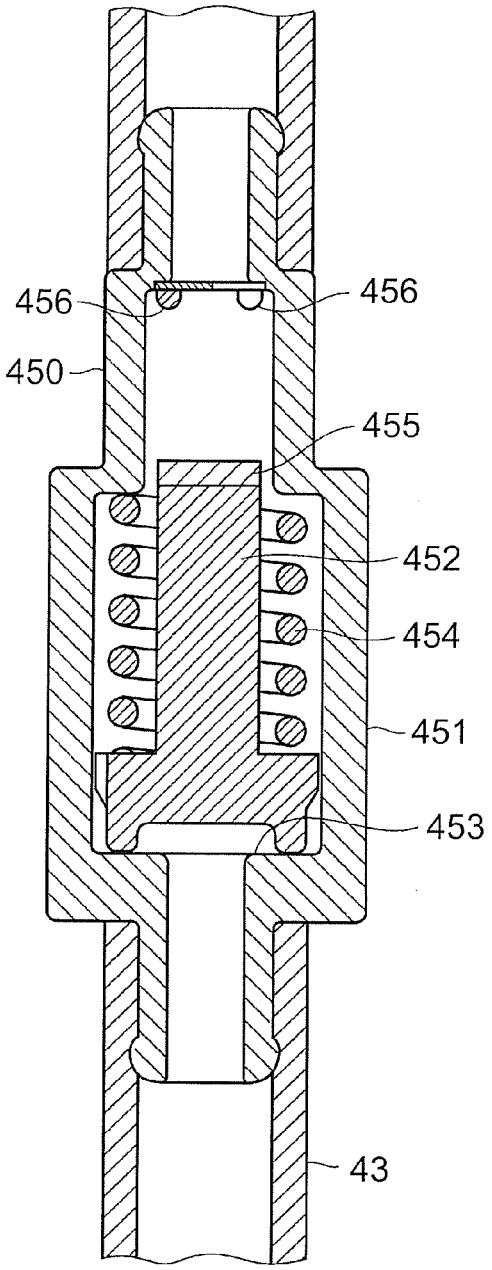
FIG. 6 is a schematic cross-sectional view that shows a check valve in a closed state, the check valve constituting the evaporative fuel treatment apparatus according to the second embodiment of the invention.
Figure 7:
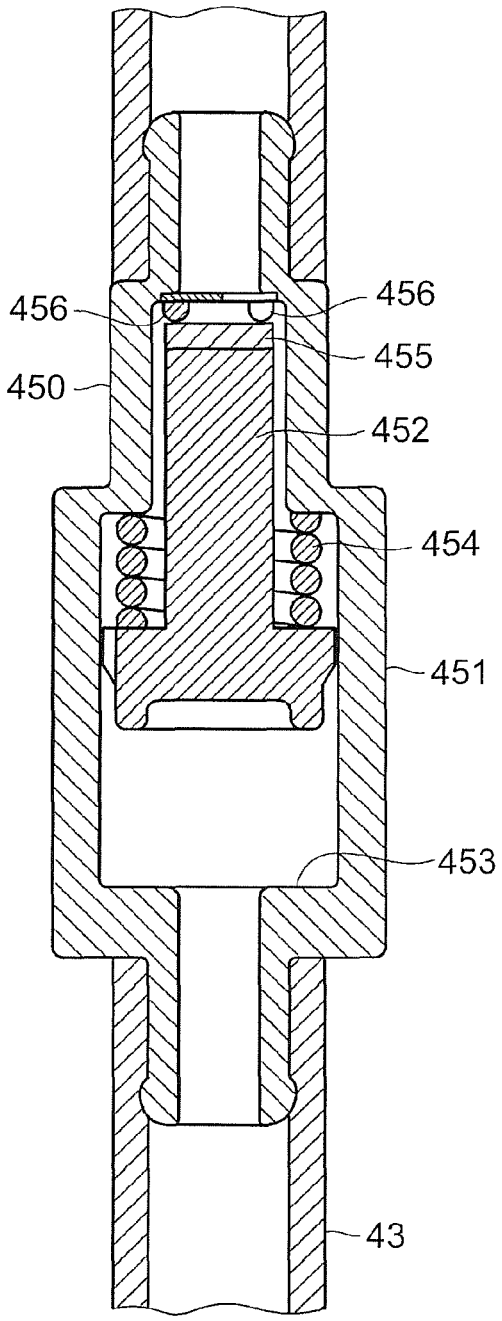
FIG. 7 is a schematic cross-sectional view that shows the check valve in an open state, the check valve constituting the evaporative fuel treatment apparatus according to the second embodiment of the invention.

As shown in FIG. 6 and FIG. 7, the check valve 450 is formed of a one-way valve that opens when the negative pressure in the intake pipe 23 is higher than a predetermined threshold and that closes when the negative pressure in the intake pipe 23 is not higher than the predetermined threshold.

In FIG. 6 and FIG. 7, the check valve 450 is provided in the purge line 43 such that the upper side in the drawing is the surge tank 23*a* side and the lower side in the drawing is the purging VSV 46 side.

The check valve 450 includes a housing 451, a valve element 452 and a coil spring 454. The valve element 452 is accommodated in the housing 451. The coil spring 454 urges the valve element 452 toward a valve seat 453 formed in the housing 451.

The check valve 450 outputs a different signal to the ECU 5 between a valve closed state shown in FIG. 6 and a valve open state shown in FIG. 7. Specifically, a first electrode 455 is provided at a lifting-side end portion of the valve element 452, and a second electrode 456 is provided at the housing 451. The second electrode 456 contacts the first electrode 455 when the check valve 450 is open.

For example, the first electrode 455 is connected to a ground, and the second electrode 456 is pulled up to a predetermined level and connected to the ECU 5. Conversely, the second electrode 456 may be connected to a ground, and the first electrode 455 may be pulled up to a predetermined level and connected to the ECU 5.

With this configuration, when the check valve 450 is in the valve closed state shown in FIG. 6, the check valve 450 outputs a signal having the predetermined level to the ECU 5; whereas, when the check valve 450 is in the valve open state shown in FIG. 7, the check valve 450 outputs a signal having the ground level to the ECU 5. That is, the ECU 5 is able to determine whether the check valve 450 is in the valve open state on the basis of the signal output from the check valve 450.

Figure 8:
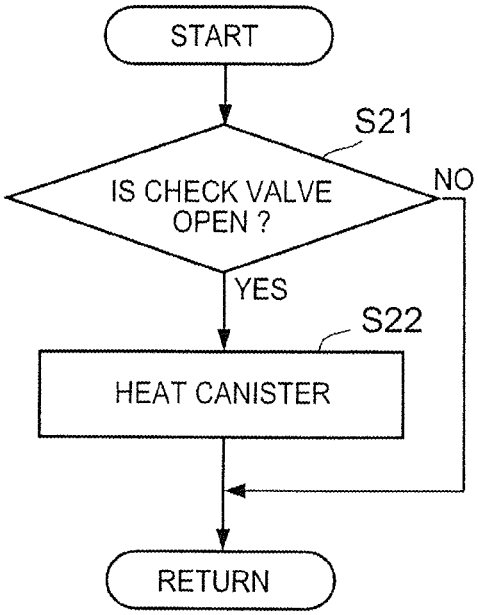
FIG. 8 is a flowchart that shows a canister temperature increasing operation of the evaporative fuel treatment apparatus according to the second embodiment of the invention.

Next, a canister temperature increasing operation of the evaporative fuel treatment apparatus according to the present embodiment will be described with reference to the flowchart shown in FIG. 8. The canister temperature increasing operation described below is repeatedly executed in a period from when the ECU 5 starts up to when the ECU 5 stops.

Initially, the ECU 5 determines whether the check valve 450 is in the valve open state on the basis of the signal output from the check valve 450 (step S21). Here, when it is determined that the check valve 450 is not in the valve open state, the ECU 5 ends the canister temperature increasing operation.

On the other hand, when it is determined that the check valve 450 is in the valve open state, the ECU 5 heats the canister 41 (step S22), and ends the canister temperature increasing operation. The process of step S22 is the same as the process of step S12 in the canister temperature increasing operation of the evaporative fuel treatment apparatus according to the first embodiment of the invention.

Next, the operation will be described.

Figure 9:
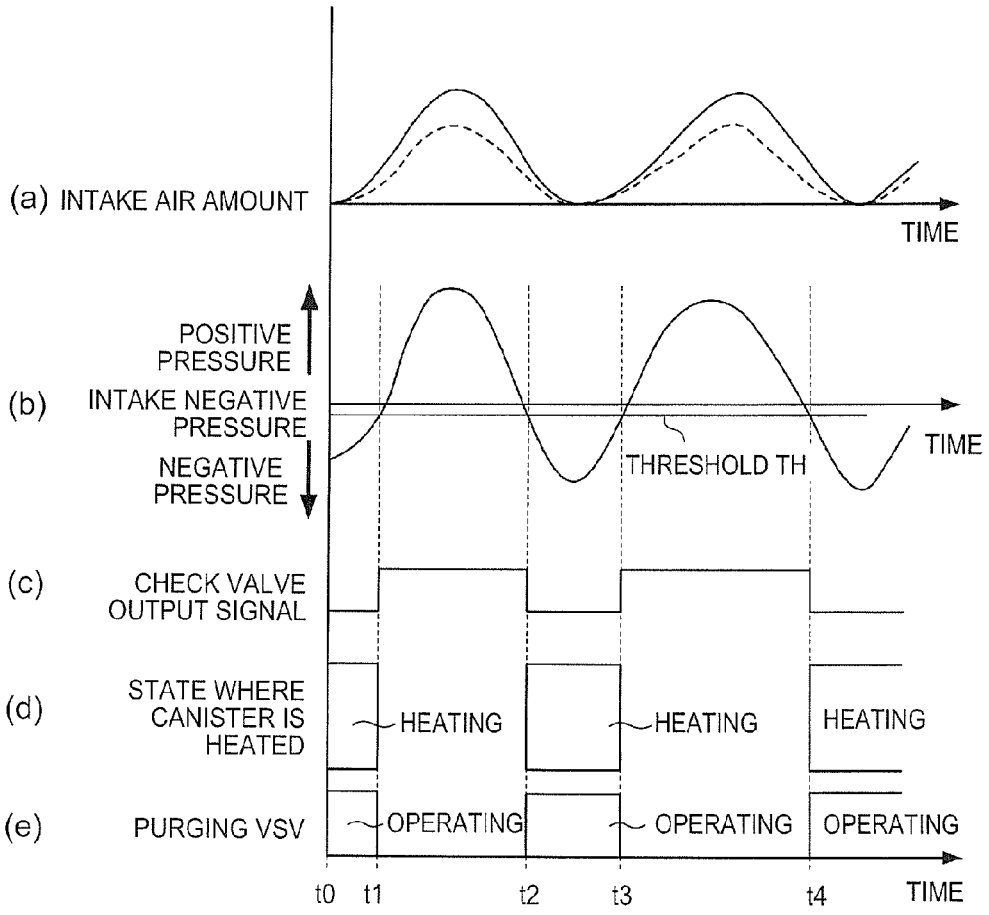
FIG. 9 is a graph that shows the relationship among various portions of the vehicle on which the evaporative fuel treatment apparatus according to the second embodiment of the invention is mounted.

In FIG. 9, (a) shows a variation in the amount of intake air that is introduced into the engine 2, (b) shows a variation in the negative pressure (intake negative pressure) in the intake pipe 23, (c) shows a variation in the output signal of the check valve 450, (d) shows a variation in the state where the canister 41 is heated, and (e) shows a variation in the operating state of the purging VSV 46.

The graph indicated by the dashed line in (a) shows the intake air amount on the assumption that the supercharger 400 is not provided. The graph indicated by the continuous line in (a) shows the intake air amount according to the present embodiment in which the supercharger 400 is provided.

In this way, when the intake air amount varies, because the vehicle 1 includes the supercharger 400, the negative pressure in the intake pipe 23, that is, the pressure in the intake pipe 23, varies between a negative pressure and a positive pressure on the basis of the intake air amount as shown in (b).

Here, in a period during which the negative pressure in the intake pipe 23 is higher than the threshold TH, specifically, in a period between time t0 and time t1, in a period between time t2 and time t3 and after time t4, the signal output from the check valve 450 becomes a ground level as shown in (c).

The ECU 5 heats the canister 41 as shown in (d) and operates the purging VSV 46 as shown in (e) in the period in which the signal output from the check valve 450 is a ground level.

As described above, according to the present embodiment, similar advantageous effects to those of the first embodiment of the invention are obtained. In addition, in the present embodiment, it is determined whether the intake negative pressure in the intake pipe 23 is higher than the threshold TH on the basis of the signal generated by the check valve 450 that opens when the intake negative pressure in the intake pipe 23 is an intake negative pressure at which it is allowed to carry out purging, so it is possible to increase the amount of heat that is transferred from the fuel pump 32 to the canister 41 at appropriate timing.

Third Embodiment

Figure 10:
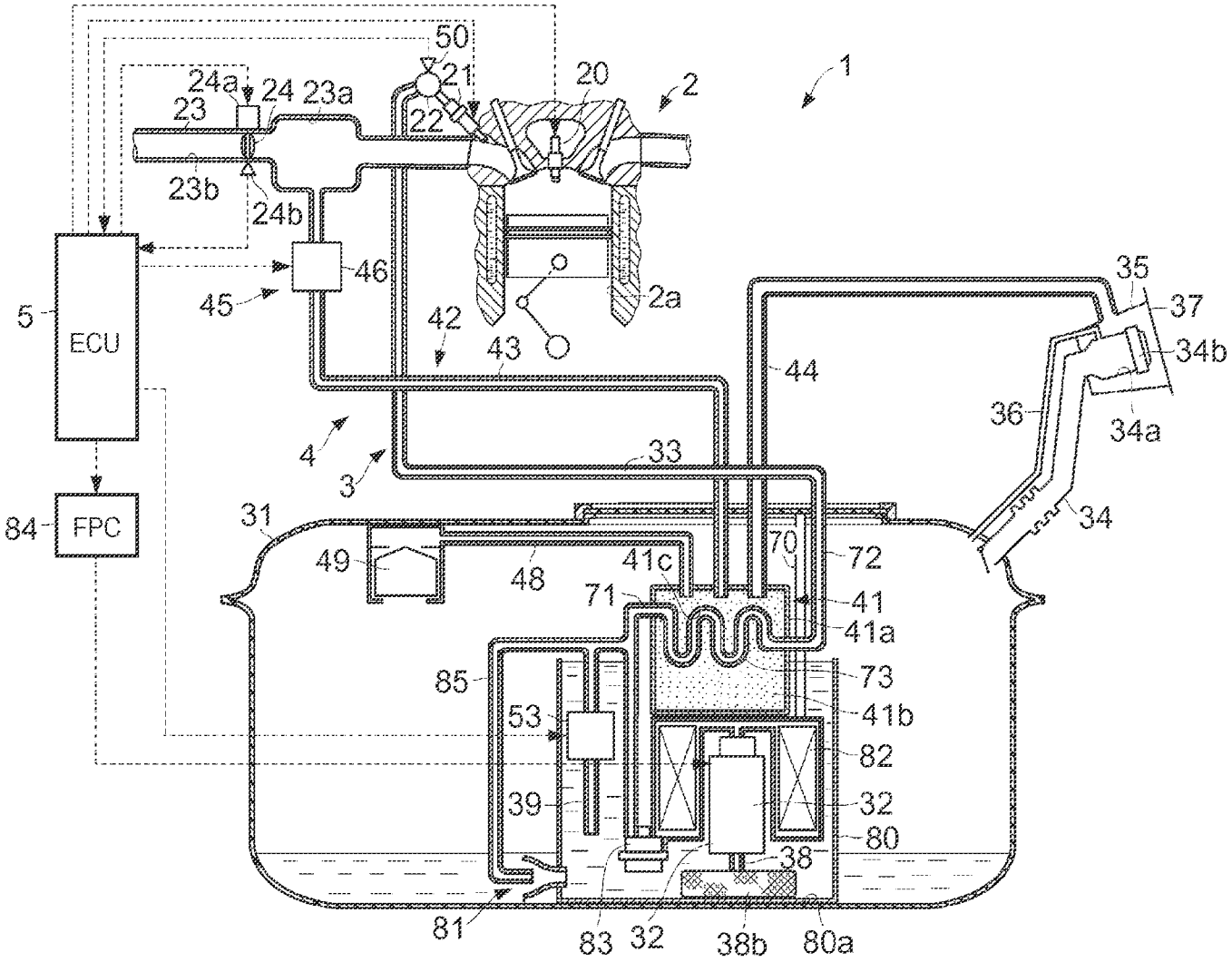
FIG. 10 is a schematic configuration view of a relevant portion, including a driving internal combustion engine and a fuel system of the internal combustion engine, in a vehicle on which an evaporative fuel treatment apparatus according to a third embodiment of the invention is mounted.

FIG. 10 shows the configuration of a relevant portion of a vehicle on which the evaporative fuel treatment apparatus according to a third embodiment of the invention, that is, the mechanism of a driving internal combustion engine and a fuel system that supplies fuel to the internal combustion engine and purges fuel from the fuel tank.

The present embodiment differs from the first embodiment in the configuration of the canister 41 and its adjacent portions; however, the other major configuration is similar to that of the first embodiment. Thus, like reference numerals denote components similar to those of the first embodiment, and the difference from the first embodiment will be described below.

In the first embodiment of the invention, part of the suction line 38 that connects the suction filter 38*b* to the fuel pump 32 is formed to pass through the inside of the canister 41. In the present embodiment, part of the fuel supply line 33 that connects the pressure regulator 83 to the delivery pipe 22 is formed to pass through the inside of the canister 41.

Specifically, the fuel supply line 33 is formed of a regulator-side connecting portion 71, a delivery pipe-side connecting portion 72 and a heat transfer line portion 73. The regulator-side connecting portion 71 is connected to the output port of the pressure regulator 83. The delivery pipe-side connecting portion 72 is connected to the delivery pipe 22. The heat transfer line portion 73 is located between these regulator-side connecting portion 71 and delivery pipe-side connecting portion 72.

Particularly, the heat transfer line portion 73 is arranged inside the canister 41. The heat transfer line portion 73, for example, has a meander shape inside the canister 41. Thus, it is possible to increase the contact area between fuel introduced into the fuel pump 32 and the adsorbent 41*b* of the canister 41 on which fuel is adsorbed, so it is possible to increase a heat transfer amount.

The shape of the heat transfer line portion 73 is not limited to the meander shape as long as it is possible to increase the contact area with the adsorbent 41*b*. For example, the shape of the heat transfer line portion 73 may be various shapes, such as a shape in which a line is branched off into a plurality of paths inside the adsorbent 41*b* and these plurality of paths are arranged in parallel with each other and a spiral shape.

Here, the heat transfer line portion 73 of the fuel supply line 33 is integrally coupled to the canister case 41*a*, and the heat transfer surface 41*c* is formed of the inner wall surface of the heat transfer line portion 73. The heat transfer surface 41*c* is the inner wall surface of the internal passage of the canister 41.

The heat transfer surface 41*c* is able to guide fuel flowing inside the fuel tank 31 during operation of the fuel pump 32, particularly, fuel that is discharged from the fuel pump 32, to the delivery pipe 22. In addition, the heat transfer surface 41*c* is allowed to transfer heat between the canister 41 and fuel flowing in the direction in which fuel is discharged from the fuel pump 32.

That is, the heat transfer line portion 73 is made of, for example, a metal raw material having a high heat conductivity such that, when there is a temperature difference between the suction-side fuel and the canister 41, it is possible to cause good heat transfer to occur at the heat transfer surface 41*c* and to efficiently transfer heat from the heat transfer line portion 73 to the adsorbent 41*b* on which fuel is adsorbed.

In addition, in the first embodiment of the invention, one end of the return line 39 at the downstream side in the return direction is connected to the suction line 38. However, in the present embodiment, one end of the return line 39 at the downstream side in the return direction is open toward the inner bottom face 80*a* of the internal tank 80.

Thus, the return line 39 is able to return fuel discharged from the fuel pump 32, more specifically, fuel, discharged from the fuel pump 32 and not supplied into the fuel supply line 33 or the pilot line 85, to around the suction filter 38*b* provided near the inner bottom face 80*a* of the internal tank 80.

The configuration of the engine 2 and its adjacent portions according to the present embodiment is the same as the configuration of the engine 2 and its adjacent portions according to the first embodiment of the invention, so the description is omitted. In addition, the canister temperature increasing operation executed by the ECU 5 according to the present embodiment is the same as the canister temperature increasing operation executed by the ECU 5 according to the first embodiment of the invention, so the description is omitted.

As described above, according to the present embodiment, similar advantageous effects to those of the first embodiment of the invention are obtained. Particularly, in the present embodiment, part of the fuel supply passage is formed of the canister 41, so it is possible to heat the canister 41 by transferring heat to the canister 41 at the time when fuel discharged from the fuel pump 32 passes through the inside of the canister 41.

In the present embodiment, the description is made on the assumption that the configuration of the engine 2 and its adjacent portions is the same as the configuration of the engine 2 and its adjacent portions according to the first embodiment of the invention and the canister temperature increasing operation executed by the ECU 5 is the same as the canister temperature increasing operation executed by the ECU 5 according to the first embodiment of the invention.

However, in the present embodiment, the configuration of the engine 2 and its adjacent portions may be the same as the configuration of the engine 2 and its adjacent portions according to the second embodiment of the invention and the canister temperature increasing operation executed by the ECU 5 may be the same as the canister temperature increasing operation executed by the ECU 5 according to the second embodiment of the invention.

Fourth Embodiment

Figure 11:
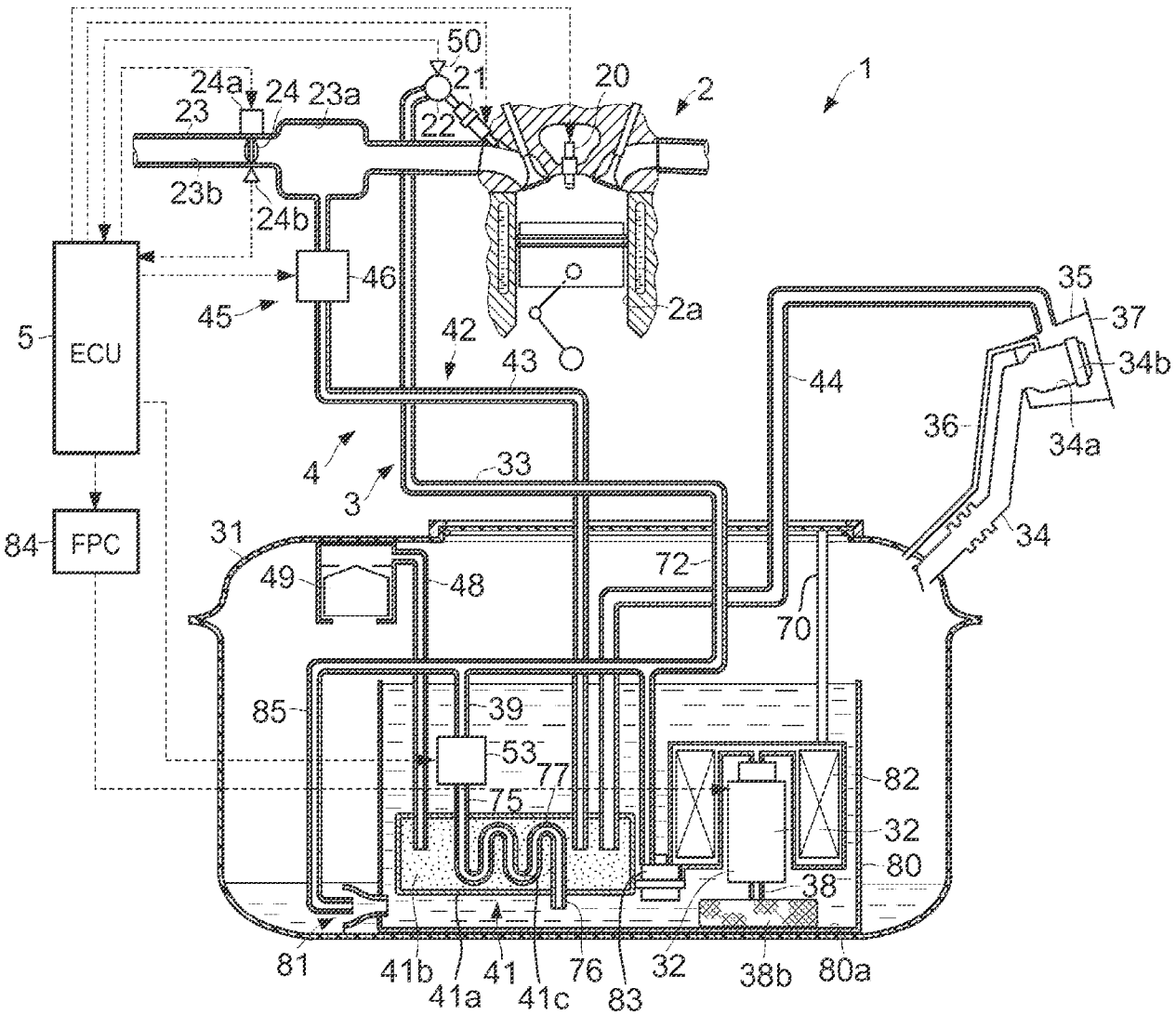
FIG. 11 is a schematic configuration view of a relevant portion, including a driving internal combustion engine and a fuel system of the internal combustion engine, in a vehicle on which an evaporative fuel treatment apparatus according to a fourth embodiment of the invention is mounted.

FIG. 11 shows the configuration of a relevant portion of a vehicle on which the evaporative fuel treatment apparatus according to a fourth embodiment of the invention, that is, the mechanism of a driving internal combustion engine and a fuel system that supplies fuel to the internal combustion engine and purges fuel from the fuel tank.

The present embodiment differs from the first embodiment in the configuration of the canister 41 and its adjacent portions; however, the other major configuration is similar to that of the first embodiment. Thus, like reference numerals denote components similar to those of the first embodiment, and the difference from the first embodiment will be described below.

In the present embodiment, the return line 39 branches off from the fuel supply line 33 at one end side near the discharge side of the fuel pump 32, and is open downward near the inner bottom portion of the fuel tank 31 at the other end side.

In addition, part of the return line 39 is formed to pass through the inside of the canister 41. Specifically, the return line 39 includes a pump-side connecting portion 75, an open-side open portion 76 and a heat transfer line portion 77. The pump-side connecting portion 75 is connected to the fuel supply line 33. The heat transfer line portion 77 is located between the pump-side connecting portion 75 and the open portion 76.

Particularly, the heat transfer line portion 77 is arranged inside the canister 41. The heat transfer line portion 77, for example, has a meander shape inside the canister 41. Thus, it is possible to increase the contact area between fuel introduced into the fuel pump 32 and the adsorbent 41*b* of the canister 41 on which fuel is adsorbed, so it is possible to increase a heat transfer amount.

The shape of the heat transfer line portion 77 is not limited to the meander shape as long as it is possible to increase the contact area with the adsorbent 41*b*. For example, the shape of the heat transfer line portion 77 may be various shapes, such as a shape in which a line is branched off into a plurality of paths inside the adsorbent 41*b* and these plurality of paths are arranged in parallel with each other and a spiral shape.

Here, the heat transfer line portion 77 of the return line 39 is integrally coupled to the canister case 41*a*, and the heat transfer surface 41*c* is formed of the inner wall surface of the heat transfer line portion 77. The heat transfer surface 41*c* is the inner wall surface of the internal passage of the canister 41.

The heat transfer surface 41*c* is able to guide fuel flowing inside the fuel tank 31 during operation of the fuel pump 32, particularly, fuel discharged from the fuel pump 32, into the fuel tank 31. In addition, the heat transfer surface 41*c* is allowed to transfer heat between the canister 41 and fuel flowing in the direction in which fuel is discharged from the fuel pump 32.

That is, the heat transfer line portion 77 is made of, for example, a metal raw material having a high heat conductivity such that, when there is a temperature difference between the discharge-side fuel and the canister 41, it is possible to cause good heat transfer to occur at the heat transfer surface 41*c* and to efficiently transfer heat from the heat transfer line portion 77 to the adsorbent 41*b* on which fuel is adsorbed.

The configuration of the engine 2 and its adjacent portions according to the present embodiment is the same as the configuration of the engine 2 and its adjacent portions according to the first embodiment of the invention, so the description is omitted. In addition, the canister temperature increasing operation executed by the ECU 5 according to the present embodiment is the same as the canister temperature increasing operation executed by the ECU 5 according to the first embodiment of the invention, so the description is omitted.

As described above, according to the present embodiment, similar advantageous effects to those of the first embodiment of the invention are obtained. Particularly, in the present embodiment, part of the return passage is formed of the canister 41, so it is possible to heat the canister 41 by transferring heat to the canister 41 at the time when fuel discharged from the fuel pump 32 and returned into the return line 39 passes through the inside of the canister 41.

In the present embodiment, the description is made on the assumption that the configuration of the engine 2 and its adjacent portions is the same as the configuration of the engine 2 and its adjacent portions according to the first embodiment of the invention and the canister temperature increasing operation executed by the ECU 5 is the same as the canister temperature increasing operation executed by the ECU 5 according to the first embodiment of the invention.

However, in the present embodiment, the configuration of the engine 2 and its adjacent portions may be the same as the configuration of the engine 2 and its adjacent portions according to the second embodiment of the invention and the canister temperature increasing operation executed by the ECU 5 may be the same as the canister temperature increasing operation executed by the ECU 5 according to the second embodiment of the invention.

Fifth Embodiment

Figure 12:
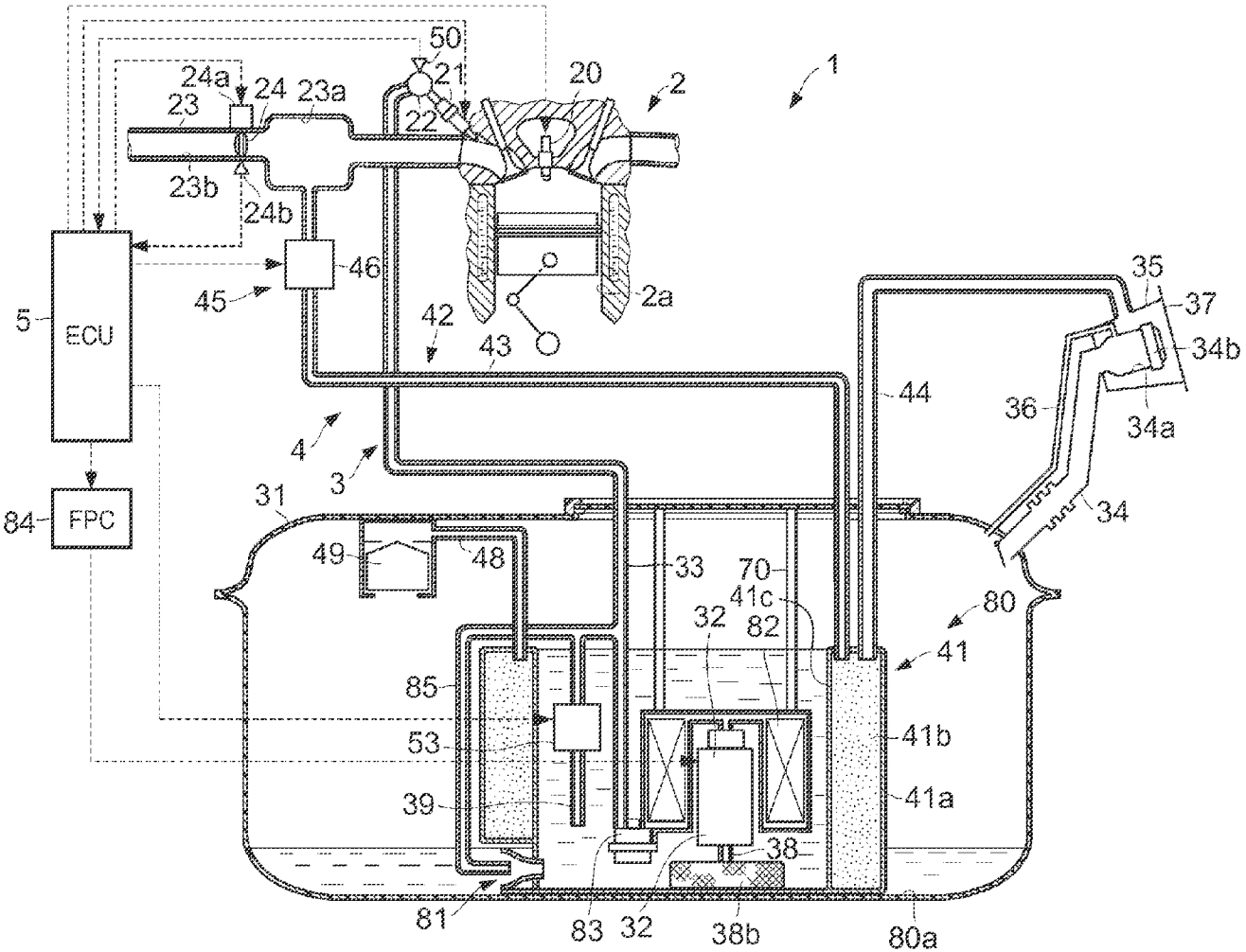
FIG. 12 is a schematic configuration view of a relevant portion, including a driving internal combustion engine and a fuel system of the internal combustion engine, in a vehicle on which an evaporative fuel treatment apparatus according to a fifth embodiment of the invention is mounted.

FIG. 12 shows the configuration of a relevant portion of a vehicle on which the evaporative fuel treatment apparatus according to a fifth embodiment of the invention, that is, the mechanism of a driving internal combustion engine and a fuel system that supplies fuel to the internal combustion engine and purges fuel from the fuel tank.

The present embodiment differs from the first embodiment in the configuration of the canister 41 and its adjacent portions; however, the other major configuration is similar to that of the first embodiment. Thus, like reference numerals denote components similar to those of the first embodiment, and the difference from the first embodiment will be described below.

In the present embodiment, the canister 41 according to the first embodiment of the invention constitutes the internal tank 80. The internal tank 80, that is, the canister 41, is formed in a substantially cylindrical shape with a bottom, and is provided inside the fuel tank 31.

The canister 41 is able to store fuel inside the cylinder. Specifically, the canister 41 includes the jet pump 81 that introduces fuel inside the fuel tank 31 into the cylinder formed by the canister 41. The jet pump 81 varies its suction amount on the basis of the operation amount of the fuel pump 32.

The shape of the canister 41 is not limited to the cylindrical shape, and may be a square tubular shape or a box shape. The shape of the canister 41 is not specifically limited. The fuel pump 32, the suction filter 38*b*, the fuel filter 82 and the pressure regulator 83 are accommodated inside the cylinder formed by the canister 41.

Here, the inner face of the cylinder formed by the canister 41 has the heat transfer surface 41*c*. The heat transfer surface 41*c* is able to guide fuel flowing inside the fuel tank 31 during operation of the fuel pump 32, particularly, fuel discharged from the fuel pump 32, in the suction direction.

In addition, the heat transfer surface 41*c* is able to transfer heat between the canister 41 and fuel flowing in the direction in which fuel is discharged from the fuel pump 32 within fuel inside the fuel tank 31.

That is, the heat transfer surface 41*c* is made of, for example, a metal raw material having a high heat conductivity such that, when there is a temperature difference between the suction-side fuel and the canister 41, it is possible to cause good heat transfer to occur and to efficiently transfer heat to the adsorbent 41*b* on which fuel is adsorbed.

The configuration of the engine 2 and its adjacent portions according to the present embodiment is the same as the configuration of the engine 2 and its adjacent portions according to the first embodiment of the invention, so the description is omitted. In addition, the canister temperature increasing operation executed by the ECU 5 according to the present embodiment is the same as the canister temperature increasing operation executed by the ECU 5 according to the first embodiment of the invention, so the description is omitted.

As described above, according to the present embodiment, similar advantageous effects to those of the first embodiment of the invention are obtained. Particularly, in the present embodiment, fuel discharged from the fuel pump 32 is actively introduced into the cylinder of the canister 41, so it is possible to heat the canister 41 from the inside of the cylinder even when fuel inside the fuel tank 31 reduces.

In the present embodiment, the description is made on the assumption that the configuration of the engine 2 and its adjacent portions is the same as the configuration of the engine 2 and its adjacent portions according to the first embodiment of the invention and the canister temperature increasing operation executed by the ECU 5 is the same as the canister temperature increasing operation executed by the ECU 5 according to the first embodiment of the invention.

However, in the present embodiment, the configuration of the engine 2 and its adjacent portions may be the same as the configuration of the engine 2 and its adjacent portions according to the second embodiment of the invention and the canister temperature increasing operation executed by the ECU 5 may be the same as the canister temperature increasing operation executed by the ECU 5 according to the second embodiment of the invention.

In addition, in the first to fifth embodiments of the invention, the configurations that the ECU 5 is able to increase the amount of heat that is transferred from the fuel pump 32 to the canister 41 are described. The evaporative fuel treatment apparatus according to the invention may employ another configuration as long as the ECU 5 is able to increase the amount of heat that is transferred from the fuel pump 32 to the canister 41.

As described above, the evaporative fuel treatment apparatus according to the invention provides such an advantageous effect that it is possible to sufficiently exercise the desorption performance of the adsorber in the vehicle equipped with the supercharger as well.

What is claimed is:

1. An evaporative fuel treatment apparatus comprising:

a fuel tank configured to store fuel for an internal combustion engine;

a fuel pump configured to draw fuel that is supplied from the fuel tank to the internal combustion engine;

an adsorber provided inside the fuel tank and configured to adsorb evaporative fuel developed inside the fuel tank;

a purge mechanism configured to carry out purging for introducing fuel, desorbed from the adsorber, into an intake pipe of the internal combustion engine;

a supercharger configured to feed air into the intake pipe; and an electronic control unit operatively connected to the fuel pump, the electronic control unit is configured to control the fuel pump to increase an amount of heat that is transferred from the fuel pump to the adsorber on a condition that an intake negative pressure in the intake pipe is higher than a predetermined threshold.

2. The evaporative fuel treatment apparatus according to claim 1, wherein the purge mechanism includes a solenoid valve configured to change an opening degree of a purge line that communicates an inside of the adsorber with an inside of the intake pipe, the evaporative fuel treatment apparatus further comprises a negative pressure sensor provided downstream of the solenoid valve in the purge line, and the electronic control unit is configured to determine whether the intake negative pressure in the intake pipe is higher than the predetermined threshold on the basis of a negative pressure measured by the negative pressure sensor.

3. The evaporative fuel treatment apparatus according to claim 1, wherein the purge mechanism includes a solenoid valve configured to change an opening degree of a purge line that communicates an inside of the adsorber with an inside of the intake pipe and a check valve provided downstream of the solenoid valve in the purge line, the check valve being configured to open when the intake negative pressure in the intake pipe is higher than the predetermined threshold and close when the intake negative pressure in the intake pipe is not higher than the predetermined threshold, the check valve is configured to generate a different signal between a valve open state and a valve closed state, and the electronic control unit is configured to determine whether the intake negative pressure in the intake pipe is higher than the predetermined threshold on the basis of the signal generated by the check valve.

4. The evaporative fuel treatment apparatus according to claim 1, wherein the electronic control unit is configured to control the fuel pump to increase the amount of heat that is transferred from the fuel pump to the adsorber via the fuel.

5. The evaporative fuel treatment apparatus according to claim 4, wherein the electronic control unit is configured to control the fuel pump to increase the amount of heat that is transferred from the fuel pump to the adsorber via fuel discharged from the fuel pump.

6. The evaporative fuel treatment apparatus according to claim 1, wherein the electronic control unit is configured to increase a driving force of the fuel pump to increase the amount of heat that is transferred from the fuel pump to the adsorber.

7. The evaporative fuel treatment apparatus according to claim 1, further comprising:

a suction line connected to the fuel pump and configured to introduce fuel from the fuel tank, a part of the suction line passing through an inside of the adsorber.

8. The evaporative fuel treatment apparatus according to claim 7, wherein the part of the suction line is formed such that a contact area of the part of the suction line with an adsorbent of the adsorber increases.

9. The evaporative fuel treatment apparatus according to claim 1, further comprising:

a fuel supply line configured to supply fuel from the fuel tank to the internal combustion engine, a part of the fuel supply line passing through an inside of the adsorber.

10. The evaporative fuel treatment apparatus according to claim 9, wherein the part of the fuel supply line is formed such that a contact area of the part of the fuel supply line with an adsorbent of the adsorber increases.

11. The evaporative fuel treatment apparatus according to claim 1, further comprising:

a fuel supply line configured to supply fuel from the fuel tank to the internal combustion engine; and a return line branched off from the fuel supply line and opening near an inner bottom portion of the fuel tank, a part of the return line passing through an inside of the adsorber.

12. The evaporative fuel treatment apparatus according to claim 11, wherein the part of the return line is formed such that a contact area of the part of the return line with an adsorbent of the adsorber increases.

13. An evaporative fuel treatment apparatus comprising:

a fuel tank configured to store fuel for an internal combustion engine;

a fuel pump configured to draw fuel that is supplied from the fuel tank to the internal combustion engine;

an adsorber provided inside the fuel tank and configured to adsorb evaporative fuel developed inside the fuel tank;

a purge mechanism configured to carry out purging for introducing fuel, desorbed from the adsorber, into an intake pipe of the internal combustion engine, the purge mechanism includes a solenoid valve configured to change an opening degree of a purge line that communicates an inside of the adsorber with an inside of the intake pipe;

a negative pressure sensor provided downstream of the solenoid valve in the purge line, the negative pressure sensor measures a negative pressure;

a supercharger configured to feed air into the intake pipe; and an electronic control unit configured to increase an amount of heat that is transferred from the fuel pump to the adsorber on a condition that an intake negative pressure in the intake pipe is higher than a predetermined threshold, the electronic control unit is configured to determine whether the intake negative pressure in the intake pipe is higher than the predetermined threshold on the basis of the negative pressure measured by the negative pressure sensor.

14. The evaporative fuel treatment apparatus according to claim 13, wherein the electronic control unit is configured to control the fuel pump to increase the amount of heat that is transferred from the fuel pump to the adsorber via the fuel.

15. The evaporative fuel treatment apparatus according to claim 14, wherein the electronic control unit is configured to control the fuel pump to increase the amount of heat that is transferred from the fuel pump to the adsorber via fuel discharged from the fuel pump.

16. The evaporative fuel treatment apparatus according to claim 13, wherein the electronic control unit is configured to increase a driving force of the fuel pump to increase the amount of heat that is transferred from the fuel pump to the adsorber.

17. An evaporative fuel treatment apparatus comprising:

a fuel tank configured to store fuel for an internal combustion engine;

a fuel pump configured to draw fuel that is supplied from the fuel tank to the internal combustion engine;

an adsorber provided inside the fuel tank and configured to adsorb evaporative fuel developed inside the fuel tank;

a purge mechanism configured to carry out purging for introducing fuel, desorbed from the adsorber, into an intake pipe of the internal combustion engine, the purge mechanism includes a solenoid valve configured to change an opening degree of a purge line that communicates an inside of the adsorber with an inside of the intake pipe and a check valve provided downstream of the solenoid valve in the purge line, the check valve being configured to open when an intake negative pressure in the intake pipe is higher than a predetermined threshold and close when the intake negative pressure in the intake pipe is not higher than the predetermined threshold, the check valve is configured to generate a different signal between a valve open state and a valve closed state;

a supercharger configured to feed air into the intake pipe; and an electronic control unit configured to increase an amount of heat that is transferred from the fuel pump to the adsorber on a condition that the intake negative pressure in the intake pipe is higher than the predetermined threshold, the electronic control unit is configured to determine whether the intake negative pressure in the intake pipe is higher than the predetermined threshold on the basis of the signal generated by the check valve.

18. The evaporative fuel treatment apparatus according to claim 17, wherein the electronic control unit is configured to control the fuel pump to increase the amount of heat that is transferred from the fuel pump to the adsorber via the fuel.

19. The evaporative fuel treatment apparatus according to claim 18, wherein the electronic control unit is configured to control the fuel pump to increase the amount of heat that is transferred from the fuel pump to the adsorber via fuel discharged from the fuel pump.

20. The evaporative fuel treatment apparatus according to claim 17, wherein the electronic control unit is configured to increase a driving force of the fuel pump to increase the amount of heat that is transferred from the fuel pump to the adsorber.

* * * * *